US005320926A

United States Patent [19]

Ueda et al.

[11] Patent Number: 5,320,926

[45] Date of Patent: Jun. 14, 1994

[54] TONER AND METHOD FOR MANUFACTURING THE SAME, AND IMAGE FORMING APPARATUS USING THE TONER

[75] Inventors: Shinjiro Ueda, Yokohama; Shuitsu Sato, Kawasaki; Miho Takigawa; Yukihiro Fujikura, both of Yokohama, all of Japan

[73] Assignee: Kabushiki Kaisha Toshiba, Kawasaki, Japan

[21] Appl. No.: 31,192

[22] Filed: Mar. 12, 1993

[30] Foreign Application Priority Data

May 21, 1992 [JP] Japan ..... 4-128354

[51] Int. Cl.[5] ..... G03G 9/08; G03G 15/08

[52] U.S. Cl. ..... 430/110; 430/111; 355/245

[58] Field of Search ..... 430/110, 111; 355/245

[56] References Cited

U.S. PATENT DOCUMENTS

| | | | |
|---|---|---|---|
| 4,051,077 | 9/1977 | Fisher | 430/110 |
| 5,124,222 | 6/1992 | Clark et al. | 430/110 X |

FOREIGN PATENT DOCUMENTS

| | | | |
|---|---|---|---|
| 0306330 | 3/1989 | European Pat. Off. . | |
| 2403640 | 8/1974 | Fed. Rep. of Germany . | |
| 2635091 | 2/1977 | Fed. Rep. of Germany . | |
| 163375 | 7/1988 | Japan | 430/110 |
| 1-309075 | 12/1989 | Japan . | |
| 141762 | 5/1990 | Japan | 430/110 |
| 3-125156 | 5/1991 | Japan . | |
| 50859 | 2/1992 | Japan | 430/110 |
| 335357 | 11/1992 | Japan | 430/110 |

OTHER PUBLICATIONS

Patent Abstracts of Japan, vol. 6, No. 237 (P-157)(1115) Nov. 25, 1982; Abstract of JP-A-57 136 659, Noguchi for "Toner Grain for Electrostatic Charge Latent Image Development."

Patent Abstracts of Japan, vol. 13, No. 47 (P-822)(3395) Feb. 3, 1989; Abstract of JP 63-240557, Satsuta for "Powder Toner".

Patent Abstracts of Japan, vol. 13, No. 129 (P-849)(3477) Mar. 30, 1989; Abstract of JP 63-300245 Inagaki for "Production of Heat Fixable Toner."

Patent Abstracts of Japan, vol. 14, No. 8 (P-987)(3951) Jan. 10, 1990; Abstract of JP 1-257855 Kawakubo for "Toner."

Patent Abstracts of Japan, vol. 14, No. 94 (P-1010)(4037) Feb. 21, 1990; Abstract of JP 1-302269, Uchiumi for "Method for Manufacturing Electrostatic Charge Image Developing Ton"

M. Koishi, Hyomen, vol. 25, No. 1, 1987, pp. 1-19.

M. Koishi et al., Hyomen, vol. 26, No. 6, 1988, pp. 404-413.

*Primary Examiner*—Roland Martin

*Attorney, Agent, or Firm*—Foley & Lardner

[57] ABSTRACT

A toner comprises a first particle having a predetermined volume average diameter and including thermoplastic binding resin and a colorant mixed into the thermoplastic binding resin to apply a color thereto. Wax of a second particle whose volume average diameter is considerably smaller than that of the first particle, is attached to the first particle by mechanical pressure. A nonmagnetic particle of a third particle is attached to the wax. The volume average diameter of the third particle is considerably smaller than that of the second particle. The attachment of the nonmagnetic particle decreases the area of an exposed surface of the wax, thereby preventing the wax from being attached to other wax and preventing the wax from contacting another toner.

9 Claims, 2 Drawing Sheets

TONER AND METHOD FOR MANUFACTURING THE SAME, AND IMAGE FORMING APPARATUS USING THE TONER

BACKGROUND OF THE INVENTION

1. Field of the Invention

The present invention relates to a toner which is used to form an image out of a toner image contact-heated and fixed on paper by a heat roller in a dry type electrostatic copying process, a method for manufacturing the toner, and an image forming apparatus using the toner.

2. Description of the Related Art

Conventionally, a contact-heating fixing method has been widely used in a dry type electrostatic copying process. According to this method, an electrostatic latent image is formed on a photoconductive layer on the surface of a drum-shaped photosensitive body, and developed by a toner to form a toner image. The toner image is contact-heated by a heat roller and fixed on paper or the like. Though the contact-heating fixing method has the advantage of high thermal efficiency and rapid fixing, it has the drawback in which an offset phenomenon appears and the paper is wound on the heat roller.

In order to eliminate the above drawback, Published Unexamined Japanese Patent Application No. 1-309075 discloses a method for attaching wax to the surfaces of toners to give a separation property to the toners heated and fused by a heat roller.

The toners disclosed in the Japanese Publication are powders of adhesive resin containing a colorant and a charging control agent, and the wax is externally attached to the powders. Since, however, the wax is easily softened at high temperature and the softened wax has tackiness, if the toners are agitated at the time of development, wax particles are softened and attached to each other or to toner particles, resulting in cohesion of the toners. If the toners cohere with one another, the toner particles are increased and, even though the toners are charged by friction with carriers in twocomponent development, they cannot be sufficiently charged. For this reason, the toners peel off to contaminate the inside of a copying machine and a blur occurs to degrade image quality.

Since the surface energy of the toners disclosed in the above Japanese Publication is small, the wax is easy to separate from the surfaces of the toner particles when the toners are agitated in a developing unit. If the separated wax is charged and attached to a photosensitive drum, a black point appears on an image, thereby degrading image quality.

Using the toners to which the wax is attached as developers, the wax separated from the toner particles is attached to the photosensitive drum to form a film and thus to prevent a good image from being formed. It is thus necessary to remove the wax from the photosensitive drum by a cleaning roller. For this reason, the conventional method has a drawback in which the photosensitive drum is much worn to reduce its durability and thus to increase a workload of maintenance.

SUMMARY OF THE INVENTION

An object of the present invention is to provide a toner which does not cohere with another toner and is capable of forming an image free from a blur or a black point, a method for manufacturing the toner, and an image forming apparatus using the toner.

According to a first aspect of the present invention, there is provided a toner comprising:

a first particle having a first volume average diameter and including thermoplastic binding resin and a colorant mixed into the thermoplastic binding resin to apply a predetermined color thereto;

a second particle attached to a surface of the first particle to improve a separation property of the first particle, and having a second volume average diameter which is considerably smaller than the first volume average diameter; and a third particle attached to a surface of the second particle to prevent the second particle from directly contacting another second particle, and having a third volume average diameter which is considerably smaller than the second volume average diameter.

According to a second aspect of the present invention, there is provided a method for manufacturing a toner, comprising the steps of:

mixing thermoplastic binding resin and a colorant for applying a predetermined color to the thermoplastic binding resin to form a first particle having a first volume average diameter;

mixing a second particle having a second volume average diameter which is considerably smaller than the first volume average diameter, with a third particle having a third volume average diameter which is considerably smaller than the second volume average diameter, and attaching the third particle to a surface of the second particle to prevent the second particle from directly contacting another second particle; and attaching the second particle to a surface of the first particle to improve a separation property of the first particle.

According to a third aspect of the present invention, there is provided an image forming apparatus comprising:

exposure means for exposing an image bearing body to form an electrostatic latent image;

development means for developing the electrostatic latent image using a toner, the toner comprising a first particle having a first volume average diameter and including thermoplastic binding resin and a colorant mixed into the thermoplastic binding resin to apply a predetermined color thereto, a second particle attached to a surface of the first particle to improve a separation property of the first particle, and having a second volume average diameter which is considerably smaller than the first volume average diameter, and a third particle attached to a surface of the second particle to prevent the second particle from directly contacting another second particle, and having a third volume average diameter which is considerably smaller than the second volume average diameter;

transfer means for transferring a toner image formed by the development means to a medium on which an image is to be formed; and fixing means for heating and fixing the toner image on the medium.

When the toner of the present invention and the toner obtained by the toner manufacturing method of the present invention are used in an image forming apparatus, no cohesion of toners occurs; therefore, an image free from a blur or a black point can be formed. Using these toners as developers, a photosensitive drum can be prevented from being damaged, and a workload of the maintenance of the apparatus can be reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

A toner, a method for manufacturing the toner, and an image forming apparatus using the toner, will now be described, with reference to the accompanying drawings.

Figures 1, 2:
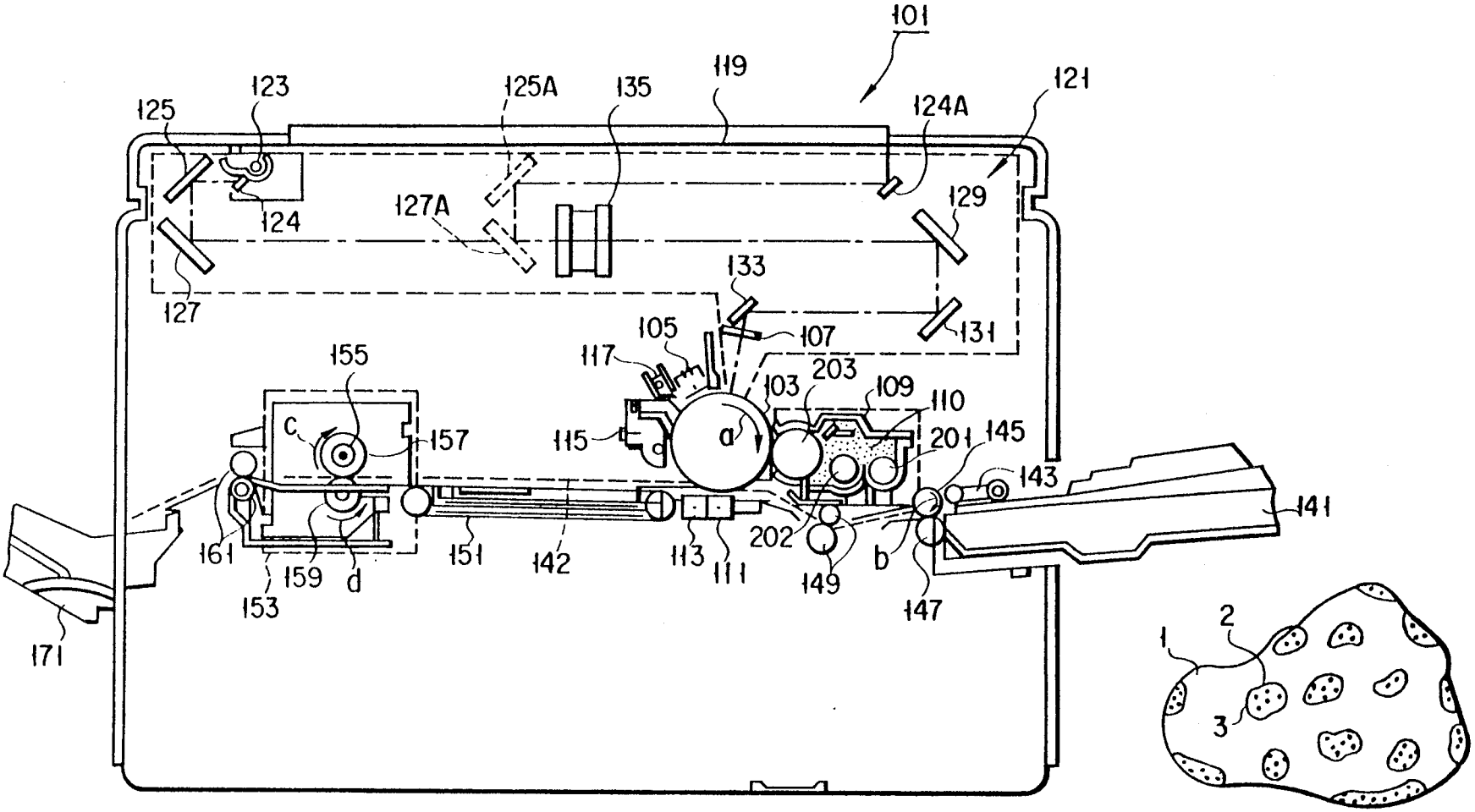
FIG. 1 is a cross-sectional view showing a constitution of an image forming apparatus such as an electrophotographic copying machine, using a toner of the present invention.
FIG. 2 is a cross-sectional view showing the toner of the present invention.

FIG. 1 shows a constitution of an electrophotographic copying machine of the present invention. As shown in FIG. 1, a drum-shaped photosensitive body 103 serving as an image bearing body is provided substantially in the central part of a body 101 of the copying machine, and can be rotated in the direction of arrow a. The following devices and units are fixedly arranged around the photosensitive body 103.

A charger 105 is arranged to uniformly charge the surface of the photosensitive body 103, and a slit glass 107 for slit-exposing a document image onto the charged photosensitive body 103 as an optical image is arranged above the photosensitive body 103 and on the downstream side of the charger 105 in the rotating direction of the body 103. A developing unit 109 for developing an electrostatic latent image on the photosensitive body 103 by attaching a toner to the latent image, is arranged on the downstream side of the slit glass 107 in the rotating direction of the body 103. The developing unit 109 contains toners 110 mixed with carriers of magnetic substances as developers. The toners will be described in detail later. The developing unit 109 includes an agitation roller 201 for agitating the developers by its rotation to triboelectrically charge them, and a supply roller 202 for supplying the developers agitated by the agitation roller 201 to a magnet roller 203. The developing unit 109 also includes a magnet roller 203 on which the north and south poles are arranged alternately in its rotating direction, and the magnet roller 203 is close to the photosensitive body 103 and can be rotated in the direction of arrow 1. A transfer unit 111 and a separation unit 113 are arranged on the downstream side of the developing unit 109 in the rotating direction of the body 103. The transfer unit 111 transfers a toner image formed by the developing unit 109 to copying paper (hereinafter referred to as paper), and the separation unit 113 separates the paper from the surface of the photosensitive body 103.

A cleaning unit 115 for removing some of the toners 110 remaining on the photosensitive body 103 after the toner image is transferred to the paper by the transfer unit 111, is arranged on the downstream side of the separation unit 113 in the rotating direction of the body 103. An elimination unit 117 for lowering the potential of the photosensitive body 103 is fixed between the cleaning unit 115 and the charger 105.

The body 101 includes a document glass 119 on which a document is placed, and an optical system 121 for irradiating the document on the document glass 119 and guiding light reflected by the document to the surface of the photosensitive body 103. The optical system 121 has a lamp 123 serving as a light source, mirrors 124, 125, 127, 129, 131 and 133 for reflecting light emitted from the light source, and a lens unit 135 for forming an image from the reflected light.

The lamp 123 and mirror 124 are arranged movably under the document glass 119, and the mirrors 125 and 127 are so constituted as to move at half of the speed of the lamp 123 in order to keep an optical path length constant. The light reflected by the mirror 133 penetrates the slit glass 107 and is guided to the surface of the photosensitive body 103.

A manual paper feeding tray 141 for storing paper is detachably provided in the middle portion on one side of the body 101, and a pickup roller 143 for picking up the paper stored in the tray 141 is provided above the end of the tray 141.

A paper discharging tray 171 for discharging the paper on which a copy image is formed, is mounted on the other side of the body 101. A carrying path 142 for carrying the paper is formed between the manual paper feeding tray 141 and the paper discharging tray 171. The carrying path 142 is represented by a dotted line in FIG. 1.

First and second pairs of rollers are attached to the body 101 in the upstream portion of the carrying path 142. The first pair of rollers is adjacent to the manual paper feeding tray 141 and includes a paper feeding roller 145 and a separation roller 147. The paper feeding roller 145 can be rotated in the direction of arrow b in FIG. 1 and is used to send the paper picked up by the pickup roller 143 to the second pair of rollers by its rotation. The separation roller 147 is arranged under and in contact with the paper feeding roller 145. When two or more sheets of paper are supplied from the pickup roller 143, the separation roller 147 is rotated in a direction opposite to that of the paper feeding roller 145 to return the extra paper to the manual paper feeding tray 141. When one sheet of paper is supplied from the pickup roller 143, the separation roller 147 is rotated in the same direction as that of the roller 145. The second pair of rollers is a resist roller 149 with an upper roller and a lower roller. The resist roller 149 aligns the paper sent from the paper feeding roller 145 when it touches the leading edge of the paper and then supplies the paper so that a toner image is put on the paper between the photosensitive body 103 and the transfer unit 111.

The transfer unit 111 and the separation 113 are arranged in substantially the middle of the carrying path 142, and a conveyer belt 151 for conveying the paper is arranged ahead of the separation unit 113. Further, a fixing unit 153 for fixing the toners 110 on the paper by heating and pressing is arranged in the downstream portion of the carrying path 142. The fixing unit 153 has a heat roller 157 and a pressing roller 159 which can be rotated in the directions of arrows c and d. The heat roller 157 includes a heat lamp 155 serving as a heater and contacts the pressing roller 159. The surface of the heat roller 157 is formed by metal of good thermal conductivity, and the surface of the pressing roller 159 is formed by elastic rubber so that the roller 159 is easy to contact the roller 157.

Furthermore, a paper discharging roller 161 for discharging the paper on which a copy image is formed, to the paper discharging tray 171, is provided in the downstream portion of the carrying path 142.

The above-described copying machine operates in the following copying process.

The surface of the photosensitive body 103 is uniformly charged by corona discharge of the charger 105. The lamp 123 of the optical system 121 scans the document glass 119 from below to emit light to a document on the glass 119. The light emitted from the lamp 123 is reflected, and the reflected light is guided to the lens unit 135. The reflected light is reversed, and guided to the charged photosensitive body 103 through the slit glass 107. If the photosensitive body 103 is exposed by the reflected light, charges are lost from the surface of the photosensitive body 103, thereby forming an electrostatic latent image.

In the developing unit 109, the toners 110 and carriers charged triboelectrically by the agitation roller 201 are supplied to the magnet roller 203 by means of the supply roller 202. The toners 110 and carriers form a magnetic brush on the magnet roller 203 by lines of magnetic force formed between the north and south poles of the magnet roller 203. The carriers are always attracted to the magnet roller 203 by magnetism, and the toners 110 and carriers are electrically attracted to each other. The magnet roller 203 and the photosensitive body 103 are rotated and, when the magnetic brush and the electrostatic latent image on the photosensitive body 103 come closer to each other, the toners 110 are separated from the carriers by stronger electrostatic attraction of the electrostatic latent image and then attached to the image. The toners 110 attached to the electrostatic latent image form a toner image. During the development, unnecessary toners 110 are prevented from attaching to the photosensitive body 103 by applying a developing bias to the magnet roller 203 and the photosensitive 103 by a voltage generator (not shown).

Paper sheets are picked from the paper feeding tray 141 by the pickup roller 143, and one of the paper sheets is conveyed to the resist roller 149 by rotation of the paper feeding roller 145 and the separation roller 147. The resist roller 149 aligns the leading edge of the paper sheet, and send it between the photosensitive body 103 and the transfer unit 111, thereby placing the electrostatic latent image of the photosensitive body 103 on the paper sheet. The toner image is transferred to the reverse side of the sheet by the function of the transfer unit 111. The sheet on which the toner image is formed, is separated from the surface of the photosensitive body 103 by the separation unit 113, and conveyed to the fixing unit 153 via the conveyer belt 151. In the fixing unit 153, the heat roller 157, which is heated by the heat lamp 155, and the pressing roller 159 are partially pressed against each other and rotated in their respective directions. During the rotation of these rollers, the paper sheet is caused to pass a portion where the two rollers are pressed so that the toner image faces the heat roller 157, thereby fixing the toner image on the sheet. In other words, the toners 110 are fused by heat of the heat roller 157, the conductive efficiency of heat is enhanced by pressure of the pressing roller 159, and the toners soak into fibers of the paper sheet.

The paper on which the copy image is formed in the foregoing process, is discharged to the paper discharging tray 171 via the paper discharge roller 161.

A toner used for the above-described electrophotographic copying machine of the present invention and a method for manufacturing the same, will now be described in detail.

EMBODIMENT 1

First, 89 parts by weight of styrene acrylic resin (Mitsui Toatsu Chemical, Inc.) is prepared as binding resin, 8 parts by weight of carbon black (MA-100: Mitsubishi Chemical Industries Ltd.) is prepared as a colorant, and 1 part by weight of triphenylmethane derivative (copy blue PR:Hoechst) and 1 part by weight of quaternary ammonium salt (P-51:Orient Chemical) are prepared as charging control agents. As a first step, these materials are uniformly mixed and then kneaded by a kneader for thirty minutes at a temperature of 140° C. They are cooled and then milled by a hammer mill to obtain first particles whose average diameter is 110 μm.

Next, a separation property is given to the first particles to prevent some of toners pressed and heated by a heat roller from remaining on the heat roller when the toners are fixed. In order to produce second particles (e.g., wax), low-molecular-weight polypropylene (VISCOL 550P:Sanyo Chemical Industries, Ltd.) is milled by a jet mill (I-type mill:Nippon Pneumatic) to obtain wax particles whose average diameter is 0.8 μm. As a second step, 1 part by weight of titanium oxide particle serving as a third particle (Titan Kogyo K.K.) whose average diameter is 0.07 μm is mixed with 5 parts by weight of the wax particles serving as the second particle by a hybridizer.

Next, 1 part by weight of the second particles with the third particles are mixed with 10 parts by weight of the first particles for three minutes by the hybridizer whose revolution speed is set to 750 rpm. The second particles are attached to the surface of the first particle by mechanically hitting the second particles against the first particle, thereby to obtain the toner shown in FIG. 2. In the toner shown in FIG. 2, wax 2 of the second particles is attached to the surface of binding resin of the first particles, and minute nonmagnetic particles 3 of third particles are attached to the surface of the wax 2.

Figure 3:
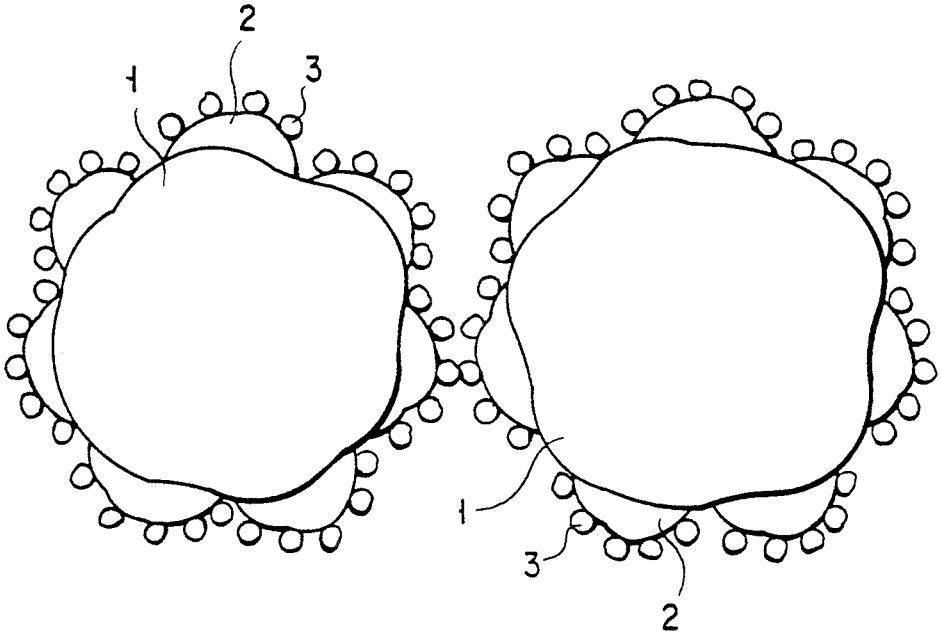
FIG. 3 is a view showing toners including particles which do not contact each other.

The second particles externally attached to the surfaces of the first particles, which are constituted by thermoplastic binding resin and colorant, do not contact each other, as shown in FIG. 3. The third particles are externally attached to the second particles. Since the second particles are mechanically hit against the first particles, they are crushed and attached to the first particles. When the toner particles serving as the first particles come closer to each other, the wax particles serving as the second particles do not contact each other, with the result that no cohesion of the toner particles occur.

97 parts by weight of ferrite carriers (TDK Corporation) were agitated and mixed with 6 parts by weight of toners by a ball mill to produce a developer. This developer was used for an electronic copying machine (ED2510:Toshiba Corporation) to make 10000 copies at a temperature of 35° C. and humidity of 75%. The images formed by the copies were good images free from black points, and cohesion of toners did not occur. Furthermore, in order to examine the offset property of the toners, the temperature of a heat roller of a fixing unit of the above electronic copying machine was increased to fix the toners. As a result, no offset phenomenon appeared until the temperature reached 240° C., and the toners had a good offset-resistant property.

EMBODIMENT 2

After the low-molecular-weight polypropylene is milled in the embodiment 1, the amount of mixture of the second particles, that is, the low-molecular-weight polypropylene to which titanium oxide is attached, with the first particles is changed from 1 part by weight to 0.08 by weight, thereby forming toners. As in the embodiment 1, a developer was prepared from these toners to make a copy, with the result that the toners had a good offset-resistant property, and no cohesion of the toners occurred or no black points were generated.

EMBODIMENT 3

After the low-molecular-weight polypropylene is milled in the embodiment 1, the amount of mixture of the second particles with the first particles is changed from 1 part by weight to 10 parts by weight, thereby forming toners. As in the embodiment 1, a developer was prepared from these toners to make a copy, with the result that the toners had a good offset-resistant property, and no cohesion of the toners occurred or no black points were generated.

EMBODIMENT 4

Hardening castor oil (Castor Wax Nippon Oil and Fats Co., Ltd.) is used for wax for preventing an offset phenomenon of the embodiment 1, thereby obtaining toners. As in the embodiment 1, a developer was prepared from these toners and evaluated. As a result, the obtained toners had a good offset-resistant property, and no cohesion of the toners occurred or no black points were generated, as in the case of the low-molecular-weight polypropylene.

EMBODIMENT 5

Polyethylene (High Wax 200P:Mitsui Petrochemical Industries, Ltd.) is used for wax for preventing an offset phenomenon of the embodiment 1, thereby obtaining toners. As in the embodiment 1, a developer was prepared from these toners and evaluated, with the result that the toners had a good offset-resistant property, and no cohesion of the toners occurred or no black points were generated.

EMBODIMENT 6

The external attachment of the titanium oxide of nonmagnetic particles of the third particles to the wax of the second particles in the embodiment 1, was executed by mechanofusion (AM-15F:Hosokawa Micron) in place of the hybridizer. The subsequent operations were the same as those of the embodiment 1. The toners of the embodiment 6 were evaluated and thus produced the same effects as those of the embodiment 1.

COMPARISON 1

87 parts by weight of styrene acrylic resin used for producing the first particles in the embodiment 1, and the same colorant and the charging control agent as those of the embodiment 1, the amount of each of which was the same as that of the styrene acrylic resin, were prepared. 3 parts by weight of low-molecular-weight polypropylene, which were not milled or to which no titanium oxide was externally attached, were mixed with the above styrene acrylic resin and the agents, and they were kneaded to obtain particles whose volume average diameter is 11 μm by the same method as that of the embodiment 1. Then, 0.2 part by weight of silica (R972: Aerogel) was mixed with the particles to form toners. As in the embodiment 1, a developer was prepared from the toners and then evaluated. As a result, an offset phenomenon appeared at a temperature of 210° C. of the fixing unit, and a black point occurred when the number of copies reached 8000.

COMPARISON 2

1 part by weight of wax of the second particles, which was milled only and to which the titanium oxide of the third particles was not attached, was externally attached to 100 parts by weight of the first particles to form a developer. The developer was evaluated as in the embodiment 1, with the result that cohesion of toners occurred and a black point was generated when the number of copies reached 3000.

Various changes and modifications to the above embodiments can be made using the following materials. The wax used in the above embodiments can be replaced with a normal series and isoparaffin which are natural products or each have 15 or more carbon atoms, a compound of the normal series and isoparaffin having an unsaturated group, chlorides of the normal series and isoparaffin, fatty acid having 15 or more carbon atoms, alcohol and ester of the fatty acid, chlorides of the alcohol and ester, fatty acid metal salt having 15 or more carbon atoms, a fatty acid amido class having a hydrocarbon chain whose carbon atoms is 15 or more, a bis fatty acid amido class, a low-molecular polyolefin compound, a silicone compound, a fluorine compound, and the like.

The nonmagnetic particles of the third particles attached to the surface of the wax of the second particles, can be replaced with silica, alumina, titanium oxide, barium titanate, magnesium titanate, calcium titanate, strontium titanate, zinc oxide, chromium oxide, ceric oxide, antimony oxide, zirconium oxide, silicon carbide, or the like. The titanium oxide and alumina are particularly suitable for the nonmagnetic particles since they hardly have a polarity and are almost neutral, and thus affect neither the charging characteristic of toners nor the carriers used in the two-component development.

The following relationships between the wax and nonmagnetic particles are favorable for attachment of the particles. Assuming that the volume average diameter of the first particle is Rt, that of the wax of the second particle is Rw, and that of the nonmagnetic particle of the third particle is Ri, the following relationships are given.

$$5\mu m \leqq Rt \leqq 20\ \mu m$$

$$0.4\ \mu m \leqq Rw \leqq 1.6\ \mu m$$

$$0.032\ \mu m \leqq Ri \leqq 0.128\ \mu m$$

As regards the ratio of mixture of the first, second and third particles, it is desirable that 100 parts by weight of the first particles, 4.8 to 43.0 parts by weight of the wax, and 6.7 to 13.9 parts by weight of the nonmagnetic particles should be added.

If the above relationships are satisfied, the nonmagnetic particles are able to cover about 50 to 100% of the surface of the wax, and the wax is able to cover about 50 to 100% of the surface of the first particle. If extra nonmagnetic particles are attached to the surface of the wax, a photosensitive drum is damaged. If the nonmagnetic particles run short, it is impossible to prevent wax from being adhered to another wax. If extra wax is attached to the surface of the first particle, cohesion of toners occurs and black points are generated. If the wax runs short, an offset phenomenon cannot be prevented.

Styrene such as polystyrene, poly-p-chlorostyrene, polyvinyltoluene, styrene-p-chlorostyrene copolymer, and styrene-vinyltoluene copolymer; a homopolymer of a substitute for the styrene; a copolymer of the styrene and the homopolymer; a copolymer of styrene such as styrenemethyl acrylate copolymer, styrene-ethyl acrylate copolymer, and styrene-n-butyl acrylate copolymer and acrylate; a copolymer of styrene such as styrene-methyl methacrylate copolymer, styrene-ethyl methacrylate copolymer, and styrene-n-butyl methacrylate copolymer and methacrylate; and the like can be used as the binding resin. Furthermore, a styrene-series copolymer of styrene such as styrene-acrylonitrile copolymer, styrene-vinyl methyl ether copolymer, styrene-butadiene copolymer, styrene-vinyl methyl ketone copolymer, styrene-acrylonitrile indene copolymer, and styrene-ester maleate copolymer and vinyl-system monomer, polymethylmethacrylate, polybutylmethacrylate, polyvinyl acetate, polyester, polyamide; epoxy resin, polyvinyl butyral, polyacrylic acid, phenolic resin, aliphatic or alicyclic, hydrocarbon resin, petroleum resin, chlorinated paraffin, and the like can also be used as the binding resin either alone or in combination.

Phthalocyanine blue, indanthrene blue, peacock blue, permanent red, lake red, Rhodamine lake, Hanza yellow, permanent yellow, benzine yellow, nigrosine dyes, aniline blue, alcoil blue, chrome yellow, ultramarine blue, Du Pont oil red, quinoline yellow, methylene blue, Malachite Green, lampblack, rose bengal, iron black, ultramarine, phthalocyanine green, calcoil blue, quinacridon, triarylmethane-series dyes, monoazo pigment, disazo pigment, and the like can be used as the colorant either alone or in combination. It is preferable to add the colorant of 0.5 to 3 wt %. If the amount of the colorant is less than 0.5 wt %, resin cannot be colored. If the amount exceeds 3 wt %, the colorant adversely affects the charging characteristic of toners.

Moreover, one or at least two of all charging control agents of the negative-electrode control agents such as alkyl salicylic acid metal chelate, chlorinated polyester, polyester having extra acid radicals, chlorinated polyolefin, metal acid of fatty acid, and soap of resin acid, and positive-electrode control agents such as dimethylaminoethylmethacrylate-styrene copolymer, fluorine activated agent, hydrophobic silica, and quaternary ammonium salt, can be used as the charging control agent.

The toners of the above embodiments are used as two-component developers, however, they can be used as monocomponent developers. Glass beads, iron powder, ferrite, magnetic particles, and the like can be used as the carriers. It is preferable to use a mixer capable of high mechanical pressure, such as a hybridizer and a mechanofusion in the process of manufacturing toners.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A toner comprising;

a first particle having a first volume average diameter and including thermoplastic binding resin and a colorant mixed into the thermoplastic binding resin to apply a predetermined color thereto;

a second particle attached to a surface of said first particle to improve a separation property of said first particle, and having a second volume average diameter which is considerably smaller than the first volume average diameter; and a third particle attached to a surface of said second particle to prevent said second particle from directly contacting another second particle, and having a third volume average diameter which is considerably smaller than the second volume average diameter.

2. The toner according to claim 1, wherein said third particle has an electrically neutral substance.

3. The toner according to claim 1, wherein said third particle has a nonmagnetic substance.

4. The toner according to claim 1, wherein said first volume average diameter of said first particle, said second volume average diameter of said second particle, and said third volume average diameter of said third particle fall within following ranges, respectively;

$$5\mu m \leqq Rt \leqq 20\ \mu m$$

$$0.4\ \mu m \leqq Rw \leqq 1.6\ \mu m$$

$$0.032\ \mu m \leqq Ri \leqq 0.128\ \mu m$$

where Rt represents said first volume average diameter of said first particle, Rw represents said second volume average diameter of said second particle, and Ri represents said third volume average diameter of said third particle.

5. An image forming apparatus comprising;

exposure means for exposing an image bearing body to form an electrostatic latent image;

development means for developing the electrostatic latent image using a toner, said toner comprising a first particle having a first volume average diameter and including thermoplastic binding resin and a colorant mixed into the thermoplastic binding resin to apply a predetermined color thereto; a second particle attached to a surface of said first particle to improve a separation property of said first particle, and having a second volume average diameter which is considerably smaller than the first volume average diameter, and a third particle attached to a surface of said second particle to prevent said second particle from directly contacting another second particle, and having a third volume average diameter which is considerably smaller than the second volume average diameter;

transfer means for transferring a toner image formed by said development means to a medium on which an image is to be formed; and fixing means for heating and fixing the toner image on the medium.

6. The toner according to claim 1, wherein the second particle is a wax.

7. The toner according to claim 6, wherein the third particle is selected from the group consisting of silica, alumina, titanium oxide, barium titanate, magnesium titanate, calcium titanate, strontium titanate, zinc oxide, chromium oxide, ceric oxide, antimony oxide, zirconium oxide and silicon carbide.

8. The toner according to claim 6, wherein the third particle is selected from the group consisting of alumina and titanium oxide.

9. The toner according to claim 7, wherein the third particles cover about 50 to 100% of the surface of the wax and the second particles cover about 50 to 100% of the surface of the first particles.

* * * * *